US008491079B2

(12) United States Patent
Iriguchi

(10) Patent No.: US 8,491,079 B2
(45) Date of Patent: Jul. 23, 2013

(54) LIQUID EJECTION APPARATUS

(75) Inventor: Akira Iriguchi, Ichinomiya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 1033 days.

(21) Appl. No.: 12/075,055

(22) Filed: Mar. 7, 2008

(65) Prior Publication Data

US 2008/0218549 A1 Sep. 11, 2008

(30) Foreign Application Priority Data

Mar. 8, 2007 (JP) ..... 2007-058831

(51) Int. Cl.
*B41J 29/38* (2006.01)

(52) U.S. Cl.
USPC ..... 347/14; 347/9; 347/10; 347/19; 347/22; 347/23; 347/27

(58) Field of Classification Search
None
See application file for complete search history.

(56) References Cited

U.S. PATENT DOCUMENTS

| | | | | |
|---|---|---|---|---|
| 5,940,106 | A * | 8/1999 | Walker | 347/104 |
| 6,663,216 | B2 * | 12/2003 | Kanaya | 347/23 |
| 2001/0050696 | A1 * | 12/2001 | Suzuki et al. | 347/27 |
| 2002/0054185 | A1 | 5/2002 | Kinoshita | |
| 2002/0149634 | A1 | 10/2002 | Fuji et al. | |
| 2007/0139487 | A1 * | 6/2007 | Sekiguchi | 347/70 |

FOREIGN PATENT DOCUMENTS

| | | |
|---|---|---|
| JP | 4235058 | 8/1992 |
| JP | 2000-255056 | 9/2000 |
| JP | 2002-205390 | 7/2002 |
| JP | 2005-131873 | 5/2005 |
| JP | 2006123452 | 5/2006 |
| JP | 2007-021974 | 2/2007 |

* cited by examiner

*Primary Examiner* — Uyen Chau N Le
*Assistant Examiner* — Chad Smith
(74) *Attorney, Agent, or Firm* — Frommer Lawrence & Haug LLP

(57) ABSTRACT

A liquid ejection apparatus includes: a liquid ejection head having a nozzle, wherein the liquid ejection head can eject a liquid from the nozzle and is movable in a predetermined direction; a first controller that controls, based on input data, liquid ejection of the liquid ejection head from the nozzle and movement of the liquid ejection head in the predetermined direction to apply the liquid onto an ejection area of a medium; a second controller that controls a flushing operation by moving the liquid ejection head to a flushing area outside the ejection area in the predetermined direction and ejecting the liquid from the nozzle of the liquid ejection head to the flushing area; a third controller that controls a minute vibration operation by vibrating the liquid in the nozzle to such an extent as not to eject the liquid from the nozzle; and a fourth controller that obtains information regarding the ejection area in the predetermined direction and that selectively controls the second controller and the third controller based on the obtained information to execute one of the flushing operation and the minute vibration operation.

6 Claims, 9 Drawing Sheets

LIQUID EJECTION APPARATUS

CROSS REFERENCE TO RELATED APPLICATION

The present disclosure relates to the subject matter contained in Japanese patent application No. 2007-058831 filed on Mar. 8, 2007, which is expressly incorporated herein by reference in its entirety.

TECHNICAL FIELD

The present invention relates to a liquid ejection apparatus including a liquid ejection head movable along a medium to eject liquid droplets onto an area of the medium.

BACKGROUND ART

In a case of a liquid ejection apparatus, such as a printing apparatus, if a liquid near a nozzle of a liquid ejection head become dry to increase its viscosity or solidify), the liquid in the nozzle may not be properly ejected as liquid droplets. In order to prevent the liquid near the nozzle from becoming dry, a flushing operation of moving the head to the outside of an ejection area and then ejecting the liquid droplets from the nozzle can be taken into consideration. Moreover, it can be also considered that the head is driven to such an extent as not to eject the liquid droplets from the nozzle to thereby mix the liquid near the nozzle and prevent the dryness of the liquid. In this connection, JP-A-2006-123452 (see, for example, claims 1 and 3) discloses a printing apparatus which includes a pressure chamber and a nozzle communicating with the pressure chamber, and which changes the volume of the pressure chamber at a predetermined period so as not to eject the liquid droplets from the nozzle. JP-A-2006-123452 also discloses a flushing operation which is executed when the nozzle remains rest for a predetermined time.

However, the following problem arises. In a case of the flushing operation, the head has to be moved to a predetermined flushing area positioned outside the ejection area. Consequently, wasteful time is required in order to move the head to the flushing area. In a case where the liquid near the nozzle is vibrated to such an extent as not to eject the liquid droplets, the head has to be driven more minutely and vibrated more number, compared with the flushing operation, in order to sufficiently generate convective flow of the liquid near the nozzle. Consequently, heat is more generated in driving means or an electrical circuit of the head, compared with the flushing operation

SUMMARY

The present invention can provide, as an illustrative, non-limiting embodiment, a liquid ejection apparatus which includes: a liquid ejection head having a nozzle, wherein the liquid ejection head can eject a liquid from the nozzle and is movable in a predetermined direction; a first controller that controls, based on input data, liquid ejection of the liquid ejection head from the nozzle and movement of the liquid ejection head in the predetermined direction to apply the liquid onto an ejection area of a medium; a second controller that controls a flushing operation by moving the liquid ejection head to a flushing area outside the ejection area in the predetermined direction and ejecting the liquid from the nozzle of the liquid ejection head to the flushing area; a third controller that controls a minute vibration operation by vibrating the liquid in the nozzle to such an extent as not to eject the liquid from the nozzle; and a fourth controller that obtains information regarding the ejection area in the predetermined direction and that selectively controls the second controller and the third controller based on the obtained information to execute one of the flushing operation and the minute vibration operation.

Accordingly, as one of advantages of the present invention, it is possible to select one of the flushing operation and the minute vibration operation based on the information regarding the ejection area. As another one of the advantages, it is possible to shorten a time period required to process the medium based on the input data using the liquid ejection head. As yet another one of the advantages, it is possible to prevent the liquid ejection head from being excessively operated.

These and other advantages of the present invention will be discussed in detail with reference to the accompanying drawings.

DESCRIPTION OF THE PREFERRED EMBODIMENT

Hereinafter, illustrative, non-limiting embodiments of the invention will be described with reference to the accompanying drawings.

Figure 1:
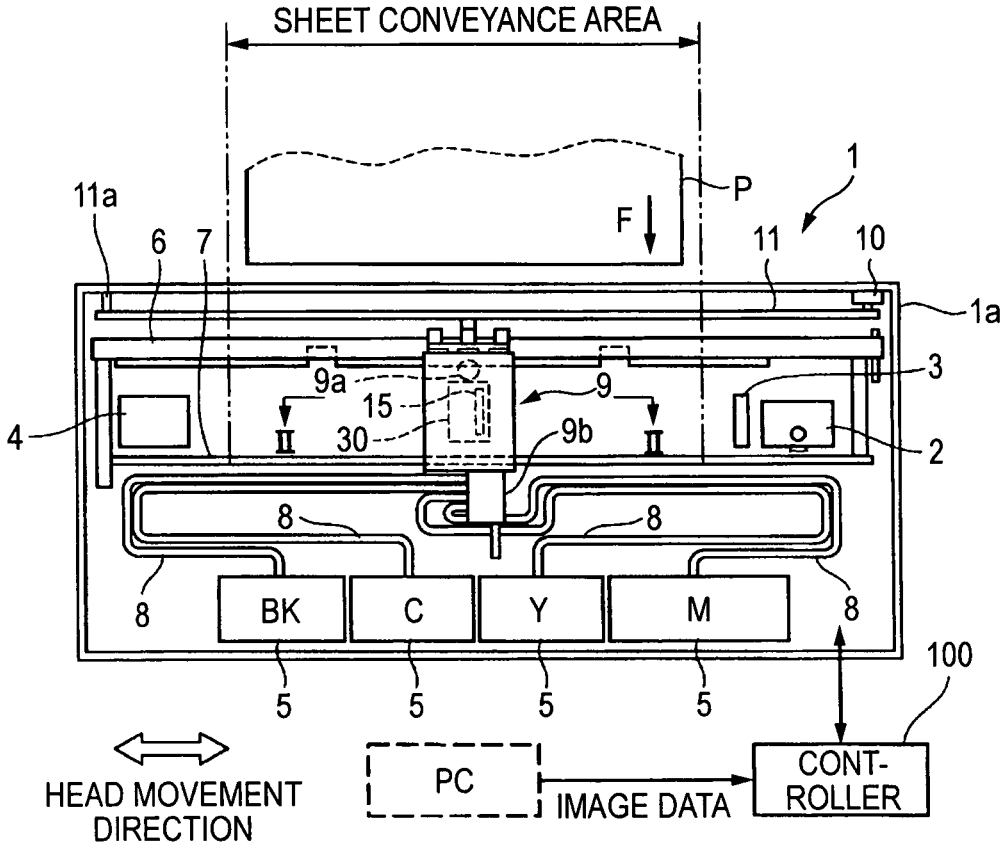
FIG. 1 is a top view illustrating an inner configuration of an ink-jet printer.

FIG. 1 is a diagram for explaining an overall configuration of an ink-jet printer 1. In the following description, a direction from the front side to the back side of FIG. 1 refers to a lower direction and a direction opposed to the direction refers to an upper direction for ease of explanation only, and these directions should not be interpreted restrictively.

As shown in FIG. 1, the ink-jet printer 1 (hereinafter, referred to simply as the "printer 1") includes a controller 100 disposed therein. The controller 100 controls an operation of each unit in the printer 1. A carriage 9 and guide shafts 6 and 7 are disposed in the printer 1. The guide shafts 6 and 7 extend in right and left directions of FIG. 1. The carriage 9 is supported on the guide shafts 6 and 7, and slidable along the guide shafts 6 and 7.

The carriage 9 supports a printing head 30 (an example of a liquid droplet ejection head) and ink tanks **9*b*. A plurality of nozzles 15 are formed on the lower surface of the printing head 30, and the ink tanks 9*b* are connected to the printing head 30. Ink cartridges 5 for storing ink of respective colors, for example, four types of ink of black BK, cyan C, magenta M, and yellow Y are accommodated in the printer 1. The ink tanks 9***b* are respectively connected to the ink cartridges 5 through flexible ink supply tubes 8. Ink passages for introducing ink from the ink tanks 9*b* to the nozzles 15, as described below, are formed in the printing head 30. Accordingly, the color ink supplied from each of the ink cartridges 5 to the ink tank 9*b* can be supplied to the nozzles 15 through the ink passages and is ejected downward from the nozzles 15 as liquid droplets (hereinafter, referred to as ink drops).

An optical sensor 9*a* is fixed to the lower surface of the carriage 9. The optical sensor 9*a* emits light, and the optical sensor 9*a* detects the light reflected and returned from a recording paper sheet (an example of a medium) P to detect whether the recording paper sheet P is positioned below the carriage 9.

The carriage 9 is connected to an endless belt 11 suspended between a pulley of a carriage motor 10 and a pulley 11*a* to reciprocate in a predetermined direction, i.e. in the right and left directions of FIG. 1, along the guide shafts 6 and 7 by forward and reverse rotation of the carriage motor 10. The recording paper sheet P is conveyed in a direction perpendicular to a movement direction of the carriage 9 in a position below the printing head 30 by a conveyance mechanism (not shown). A movement range of the carriage 9 is larger than the maximum width of the recording paper sheet P which can be printed by the printer. That is, the movement range of the carriage 9 is larger than a sheet conveyance area of the printer.

Printing pattern data corresponding to an image is transmitted from an external apparatus such as a PC (personal computer) to the controller 100. The controller 100 forms the image corresponding to the printing pattern data on the recording paper sheet P by controlling the conveyance mechanism and the carriage motor 10 and driving the printing head 30 on the basis of the printing pattern data transmitted from the PC or the like as described below.

The printer 1 includes a flushing receptacle 4. The flushing receptacle 4 is disposed in the left outside of the sheet conveyance area and below the guide shafts 6 and 7. The flushing receptacle 4 houses a porous ink absorption member, such as urethane foam, therein. When the carriage 9 having the printing head 30 is moved from a position inside or outside the sheet conveyance area to a position (flushing area) opposite the flushing receptacle 4 and the ink drops are ejected from the printing head 30, the ink drops is absorbed by the ink absorption member in the flushing receptacle 4.

The printer 1 includes a recovery unit 2. The recovery unit 2 is disposed in the right outside of the sheet conveyance area and below the guide shafts 6 and 7. The recovery unit 2 includes a suction cap (not shown) contactable with a nozzle surface of the printing head 30 and a suction pump (not shown) connected to the suction cap. When the carriage 9 having the printing head 30 is moved from a position inside or outside the sheet conveyance area to a position (recovery area) opposite the suction cap and the suction cap covers the nozzle area of the printing head 30, the ink in the nozzles of the printing head 30 can be drawn under vacuum by driving the suction pump.

The recovery area may be used as the flushing area. That is, the flushing operation can also be performed such that the printing head 30 at a position opposite the suction cap ejects the ink drops toward the suction cap. Hereinafter, the flushing area defined by the flushing receptacle 2 and the recovery area defined by the recovery unit 2 will be referred to as the flushing area 2 and the flushing area 4, respectively, when applicable.

The printer 1 includes a wiper unit 3. When the carriage 9 is moved toward the sheet conveyance area after the above-described suction operation, the wiper unit 3 wipes the nozzle area of the printing head 30.

Figure 2:
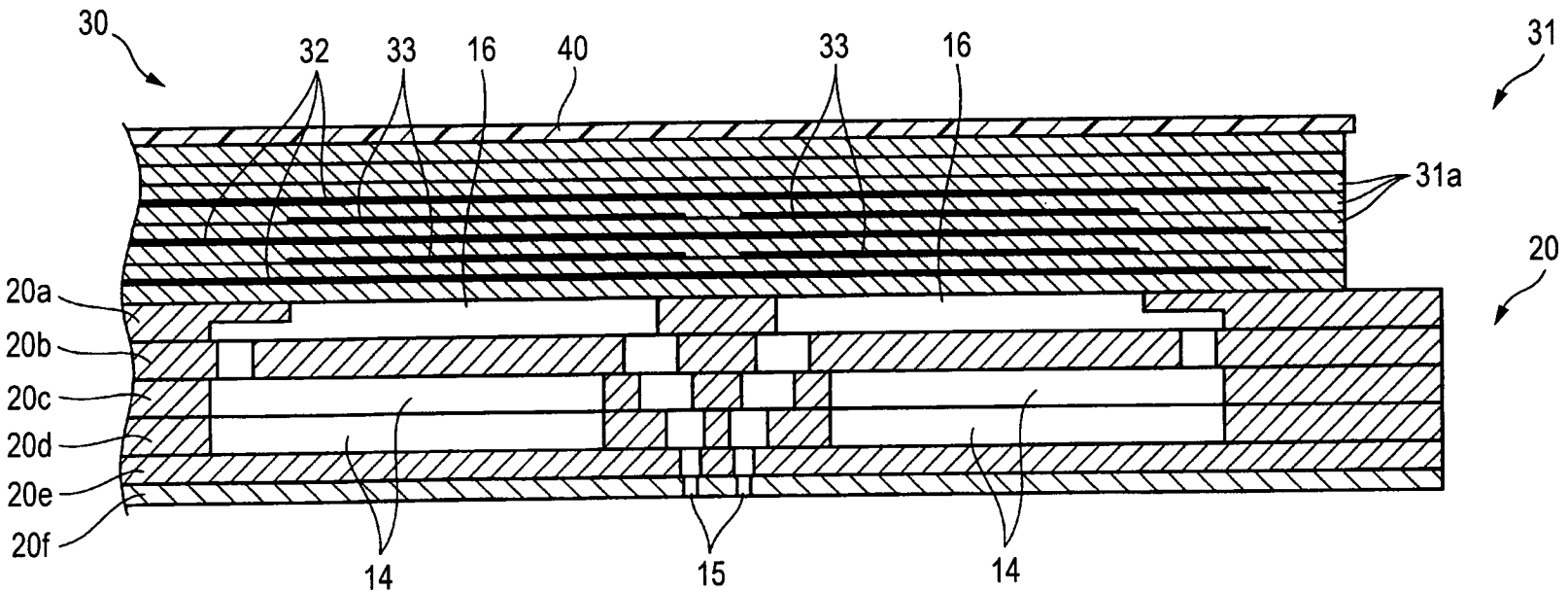
FIG. 2 is a cross sectional view illustrating a printing head taken along the line II-II in FIG. 1.

Hereinafter, the printing head 30 will be further described with reference to FIG. 2. FIG. 2 is a cross sectional view illustrating the printing head 30 taken along the line II-II in FIG. 1. The printing head 30 includes a flow passage unit 20 and an actuator unit 31 adhered on the flow passage unit 20 by an adhesive. A flexible wiring board 40 is disposed on the upper surface of the actuator unit 31.

The flow passage unit 20 is configured by laminating a plurality of plates 20*a* to 20*f*. A plurality of through-holes for forming the ink passage are formed on each of the plates 20*a* to 20*f*. The through-holes formed in the plates 20*c* and 20*d* form a manifold flow passage 14 for each color ink. Although not show in FIG. 2, the manifold flow passages 14 are respectively connected to the ink tanks 9*b*.

The through-holes formed in the uppermost plate 20*a* of the flow passage unit 20 form a plurality of pressure chambers 16, each having a shape elongating in one direction in a plan view. The through-holes formed in the lowermost plate 20*f* form a plurality of nozzles 15. The pressure chambers 16 and the nozzles 15 for each color ink are arrayed on and along a straight line in a plan view. The nozzles 15 are respectively communicated with the pressure chambers 16 so as to make one-to-one correspondence to each other. The plates 20*a* to 20*f* are laminated and the through-holes are communicated with each other, thereby forming the ink passages from the manifold flow passages 14 to the nozzles 15 through the plurality of pressure chambers 16.

The actuator unit 31 is constructed by alternately laminating plural piezoelectric ceramic layers 31*a* made of PZT (lead zirconate titanate) or the like, common electrodes 32, and individual electrodes 33. In a plan view, each set of the individual electrodes 33 are located at a position overlapped with a respective one of the pressure chambers 16 formed in the flow passage unit 20. In a plan view, the common electrodes 32 are laid over plural areas in which the individual electrodes 33 are respectively arranged. The common electrodes 32 and the individual electrodes 33 are electrically connected to wirings formed on the flexible wiring board 40 through terminals (not shown).

The actuator unit 31 is driven by a driving pulse supplied through the flexible wiring board 40 in the following manner. The common electrodes 32 are all held at a ground potential. A driving pulse is supplied to the individual electrodes 33 through the flexible wiring board 40 to generate a potential difference between the individual electrodes 33 and the common electrodes 32. The potential difference causes deformation of piezoelectric ceramic layers 31*a* to apply a pressure to ink in the pressure chamber 16, to thereby eject the ink as ink drops from the nozzle 15.

Hereinafter, an electrical configuration of the printer 1 will be described with reference to FIGS. 3 and 4.

Figure 3:
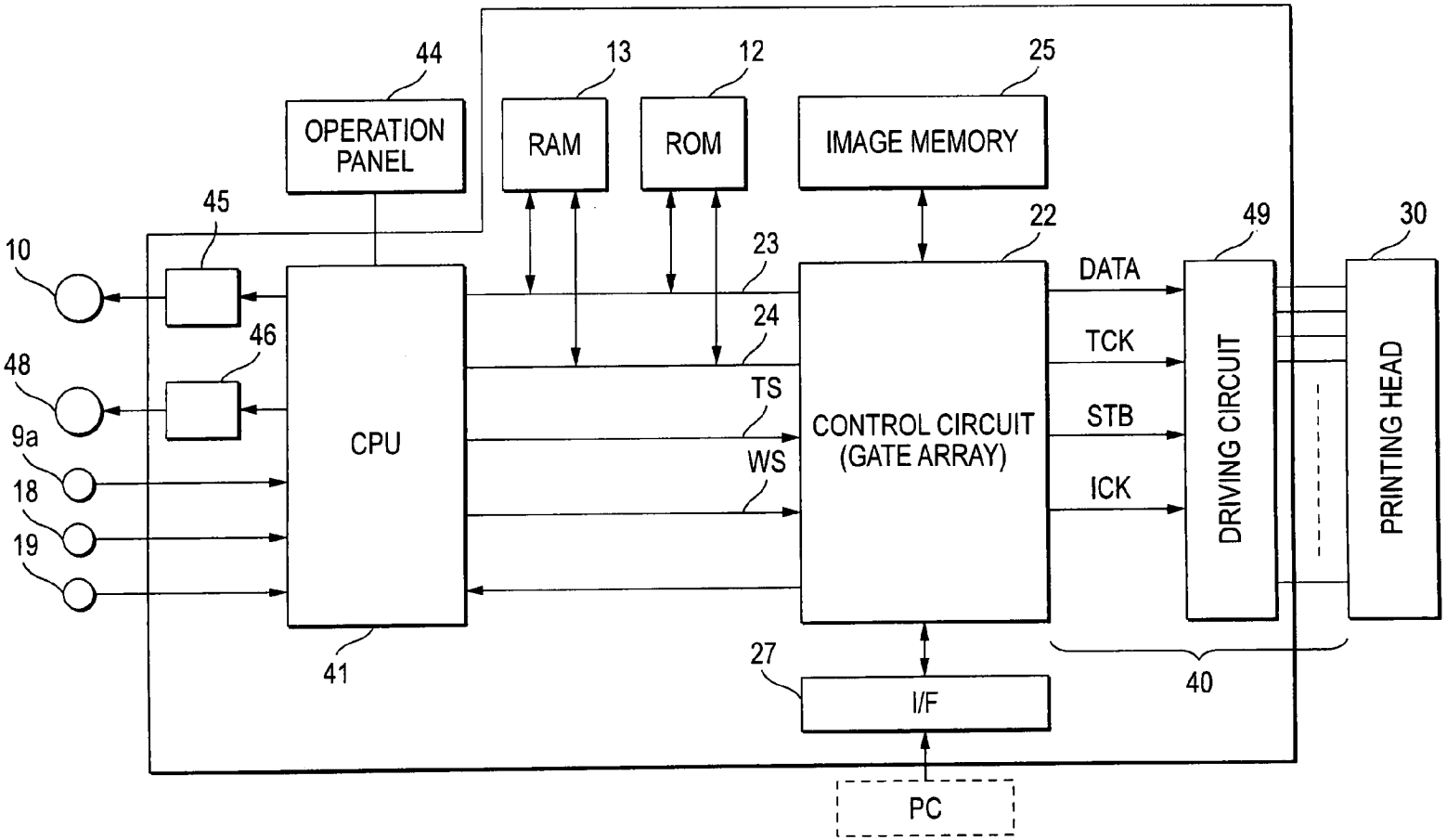
FIG. 3 is a block diagram illustrating an electrical configuration of the ink-jet printer in FIG. 1.

FIG. 3 is a block diagram illustrating the electrical configuration of the printer 1. The controller 100 of the printer 1 includes a CPU (central processing unit) 41, a control circuit 22, a ROM (read-only memory) 12, a RAM (random access memory) 13, an interface 27, motor drivers 45 and 46, an image memory 25, and a driving circuit 49. The ROM 12 stores a control program and various drive waveform data for ejecting ink drops. The RAM 13 temporarily stores various job data and the like. The CPU 41, the ROM 12, the RAM 13, and the control circuit 22 are connected to each other through an address bus 23 and a data bus 24. In addition, the CPU 41 operates on the basis of the control program preliminarily stored in the ROM 12 to execute various control operations.

An operation panel 44, motor drivers 45 and 46, and the optical sensor 9*a* are connected to the CPU 41. A conveyance motor 48 drives the conveyance mechanism of the recording paper sheet. The motor drivers 45 and 46 control the carriage motor 10 and the conveyance motor 48, respectively. The printer 1 includes an original point sensor 18 for detecting whether the printing head 30 is positioned at an original point and an ink cartridge sensor 19 for detecting whether the ink cartridge 5 is properly mounted. Each detection result of the original point sensor 18 and the ink cartridge sensor 19 are input to the CPU 41. On the basis of the detection result of the original point sensor 18 and the controlled variable of the motor driver 45, the controller 100 can acquire information regarding a position of the printing head 30 in a direction in which the guide shafts 6 and 7 extend.

The control circuit 22 includes a gate array circuit connected to the interface 27 and the image memory 25. The control circuit 22 is connected to the printing head 30 through the flexible wiring board 40. The driving circuit 49 is mounted on the flexible wiring board 40 so that a signal from the control circuit 22 is transmitted to the printing head 30 through the driving circuit 49.

The control circuit 22 stores, in the image memory 25, the printing pattern data transmitted from the external apparatus such as a PC through the interface 27. The control circuit 22 generates a reception interrupt signal WS on the basis of data transmitted through the interface 27 from the external apparatus such as a PC, and transmits the signal WS to the CPU 41. Upon reception of the signal WS, the CPU 41 generates a print timing signal TS and a control signal RS, and transmits the print timing signal TS and the control signal RS to the control circuit 22. Upon reception of the print timing signal TS and the control signal RS, the control circuit 22 generates a print data signal DATA on the basis of the printing pattern data stored in the image memory 25. The print data signal DATA is a serial data signal for controlling the printing head 30 to eject ink drops so as to form an image corresponding to the printing pattern data. The control circuit 22 generates a transmission clock TCK and a strobe signal STB. The control circuit 22 generates a driving waveform signal ICK on the basis of the drive waveform data stored in the ROM 12. The drive waveform signal ICK includes a plurality of waveform signals described below. The signals DATA, TCK, STB, and ICK are transmitted to the drive circuit 49.

Figure 4:
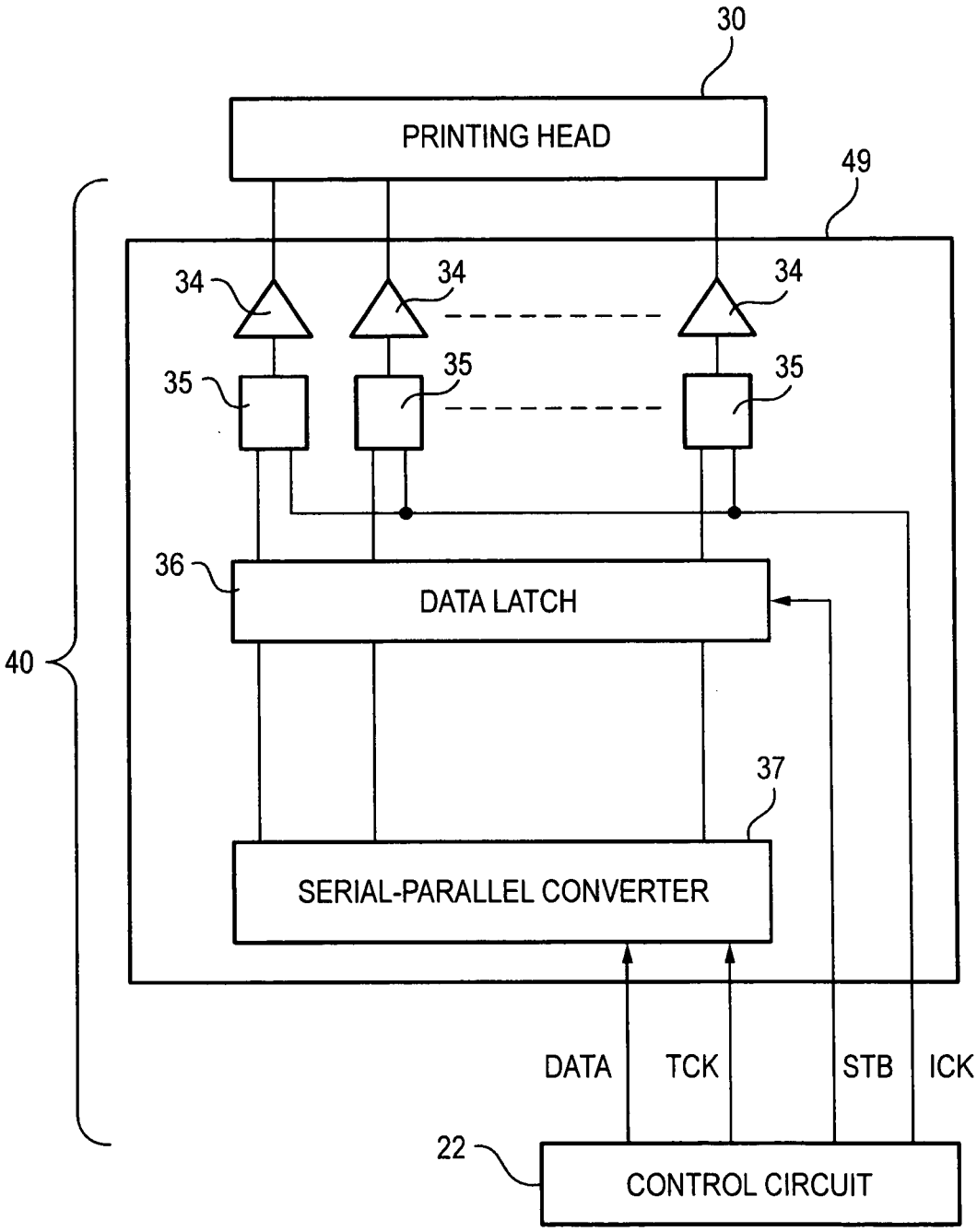
FIG. 4 is a block diagram illustrating a configuration of a driving circuit in FIG. 3.

FIG. 4 is a block diagram illustrating a configuration of the driving circuit 49. The driving circuit 49 includes a serial-parallel converter 37, a data latch circuit 36, a selection circuit 35, and a driver circuit 34. The output terminals of the serial-parallel converter 37, the number of the input and output terminals of the data latch circuit 36, the selection circuits 35 and the driver circuits 34 correspond in number to the nozzles 15 formed in the printing head 30. The signal DATA from the control circuit 22 together with the signal TCK are input to the serial-parallel converter 37.

The serial-parallel converter 37 converts, into parallel data, the signal DATA transmitted from the control circuit 22 in synchronization with the signal TCK, and outputs the converted parallel data to the data latch circuit 36. The data latch circuit 36 latches the parallel data from the serial-parallel converter 37 on the basis of the strobe signal STB, and outputs the parallel data to the selection circuit 35. The selection circuit 35 selects the signal ICK corresponding to a waveform which the parallel data from the data latch circuit 36 represents, and outputs the signal ICK to the driver circuit 34. The driver circuit 34 converts the signal ICK from the selection circuit 35 into a voltage suitable for the actuator unit 31, and outputs the voltage to the individual electrodes 33 of the printing head 30 as the driving pulse.

Hereinafter, the driving waveform signal ICK supplied to the driving circuit 49 will be described in more detail with reference to FIG. 5. The signal ICK can correspond to at least three types of waveforms. A first type of the waveforms is a printing waveform (not shown) used to form an image on the recording paper sheet P by ejecting the ink drops from the printing head 30. A second type of the waveforms is a flushing operation waveform 51 (FIG. 5(*a*)) used to eject the ink drops from the printing head 30 toward the flushing receptacle 4. A third type of the waveforms is a minute vibration waveform 52 (FIG. 5(*b*)) used to minutely vibrate the ink (meniscus) near the nozzle 15.

Figure 5A:
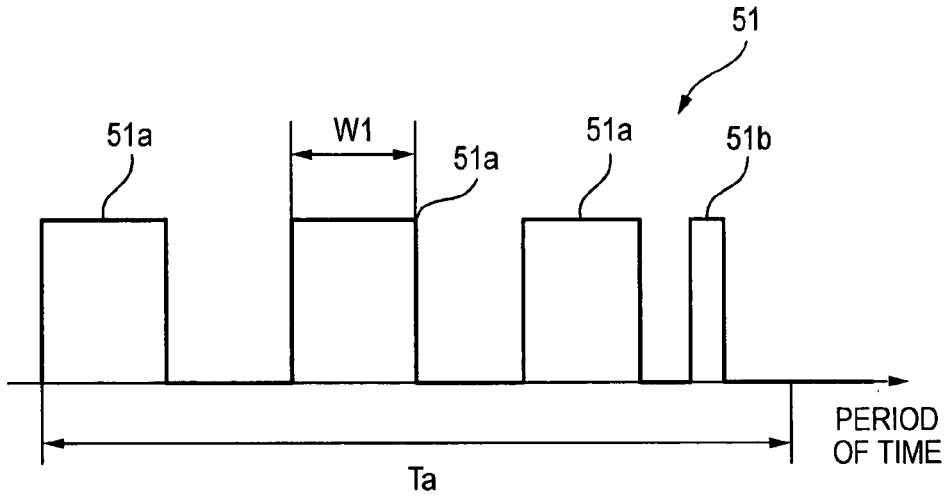
FIG. 5 is a diagram illustrating a waveform of a driving waveform signal supplied from the driving circuit in FIG. 3.
Figure 5B:
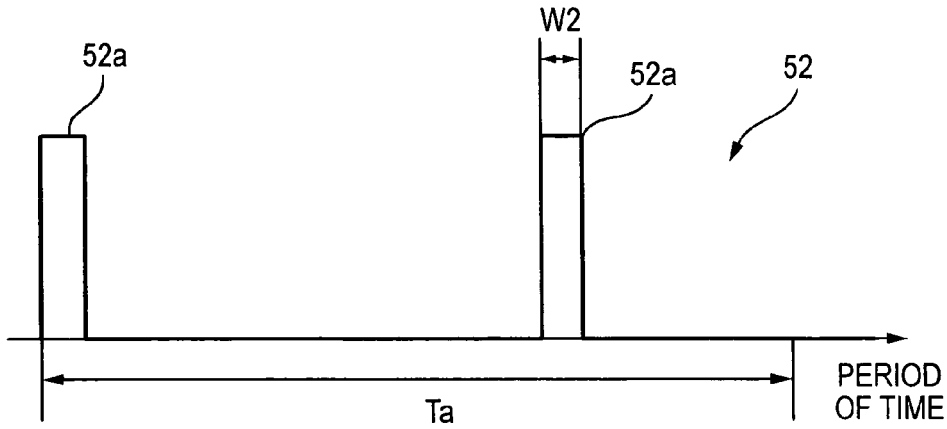

One flushing operation waveform signal 51 shown in FIG. 5(*a*) contains three ejection drive pulses 51*a* and one non-ejection drive pulse 51*b* within one drive period Ta corresponding to a period of time in which one dot is formed on the recording paper sheet. When one drive pulse 51*a* is supplied to the individual electrodes 33, a potential of the individual electrodes 33 varies up to the height of the drive pulse 51*a*, and one ink drop per one drive pulse 51*a* is ejected from the nozzle 15 corresponding to the individual electrodes 33. Consequently, when three drive pulses 51*a* are supplied, the total three ink drops are ejected. On the other hand, the non-ejection drive pulse 51*b* is applied at a timing at which an ink residual pressure wave generated by the ejection drive pulse can be substantially cancelled. The width of the non-ejection drive pulse 51*b* is smaller than that of the ejection drive pulse 51*a*. Even when the non-ejection drive pulse 51*b* is supplied to the individual electrodes 33, the ink drop is not ejected from the nozzle 15, similarly to a drive pulse 52*a* described below.

The minute vibration waveform 52 shown in FIG. 5(*b*) contains two non-ejection drive pulses 52*a* within the one drive period Ta. A pulse width W2 of the drive pulse 52*a* is smaller than a pulse width W1 of the drive pulse 51*a*. Since the potential of the individual electrodes 33 gradually increases in the piezoelectric actuator similarly to a condenser, the deformation of the piezoelectric ceramic layers can be made small by setting the pulse width W2 such that supply of the one pulse is terminated before the potential of the individual electrodes 33 reaches magnitude corresponding to the height of the pulse. That is, the pulse width W2 has been adjusted to such an extent that the ink drop is not ejected from the nozzle 15.

The controller 100 controls the printing head 30 and the motor drivers 45 and 46 in the following manner to execute at least three types of control operations. A first type of the control operations is a printing control operation. The controller 100 moves the carriage 9 and also supplies the printing waveform signal to the printing head 30 on the basis of the printing pattern data transmitted from a PC. In this way, an image on the basis of the printing pattern data is formed on the recording paper sheet P. That is, the controller 100 can serve as a printing controller. In a case of the printer 1 shown in FIG. 1, the controller 100 controls the carriage 9 and the print head 30 to form one line of the image, while moving the printing head 30 one time along the printing area of the image, for example, from the right side to the left side, and also controls the conveyance unit to convey the printing sheet P each time after the printing head 30 has formed one line.

A second type of the control operations is a flushing operation control operation. The controller 100 controls the carriage 9 so that the printing head 30 is located at a position (the flushing area) opposite the flushing receptacle 4, and supplies a signal made up of a predetermined number of the flushing operation waveforms 51 to the printing head 30. In this way, the flushing operation of ejecting the ink drops from the nozzles 15 is performed irrespective of the printing pattern data. That is, the controller 100 can serve as a flushing operation controller. When the flushing operation is appropriately performed (for example, tens number of times, assuming that the one period Ta is one time), the ink near the nozzles 15 is substituted, thereby preventing dry of the ink near the nozzle 15 and maintaining a proper ink drop ejection performance.

A third type of the control operations is a minute vibration control operation. The controller 100 controls the print head 30 to minutely vibrates the ink near the nozzles 15 without ejecting the ink drop from the nozzle 15 by supplying a signal made up of a predetermined number of the minute vibration waveforms 52 to the printing head 30. In this way, the controller 100 can serve as a minute vibration controller. When the minute vibration operation is appropriately performed (for example, about 200 to 300 times, assuming that the one period Ta is one time), the ink near the nozzles 15 is agitated, thereby preventing dry of the ink near the nozzle 15 and maintaining the proper ink drop ejection performance. This minute vibration operation can be performed after printing on one line ends and before printing on a next line starts, in particular, during when the carriage 9 having the printing head 30 is decelerated, reversed and then accelerated. The flushing operation and the minute vibration operation are collectively referred to as a dry prevention operation.

Figure 7:
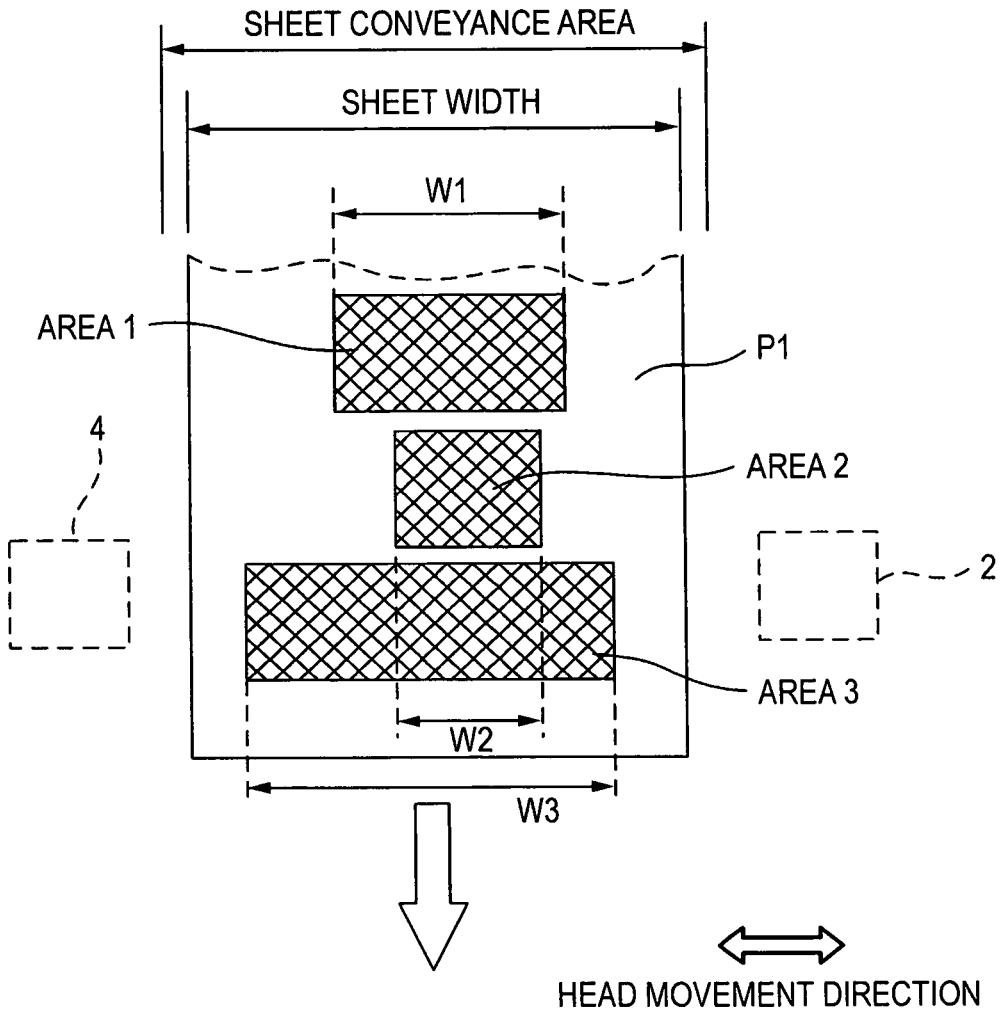
FIG. 7 is a diagram illustrating a relationship of a printing area in which an image is formed on a printing sheet, the width of the printing sheet, and a flushing area.
Figure 8:
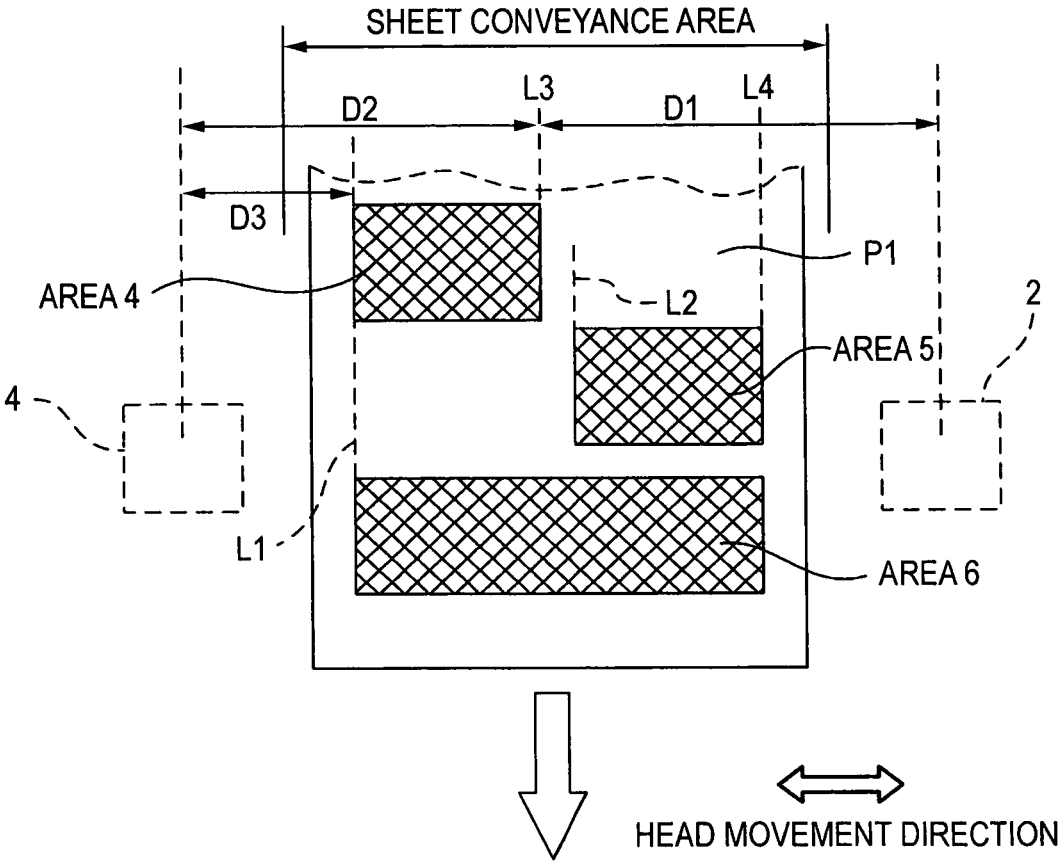
FIG. 8 is a diagram illustrating a relationship between a printing area and a flushing area.

Hereinafter, the dry prevention operation will be described with reference to FIGS. 6 to 9. In FIGS. 7 and 8, only the recording paper sheet P1 conveyed in the sheet conveyance area, the flushing housing member 4, and the recovery unit 2 are illustrated in a plan view, and the illustration for the other configuration is omitted to simplify the drawings and clarify positional relationships.

Figure 6:
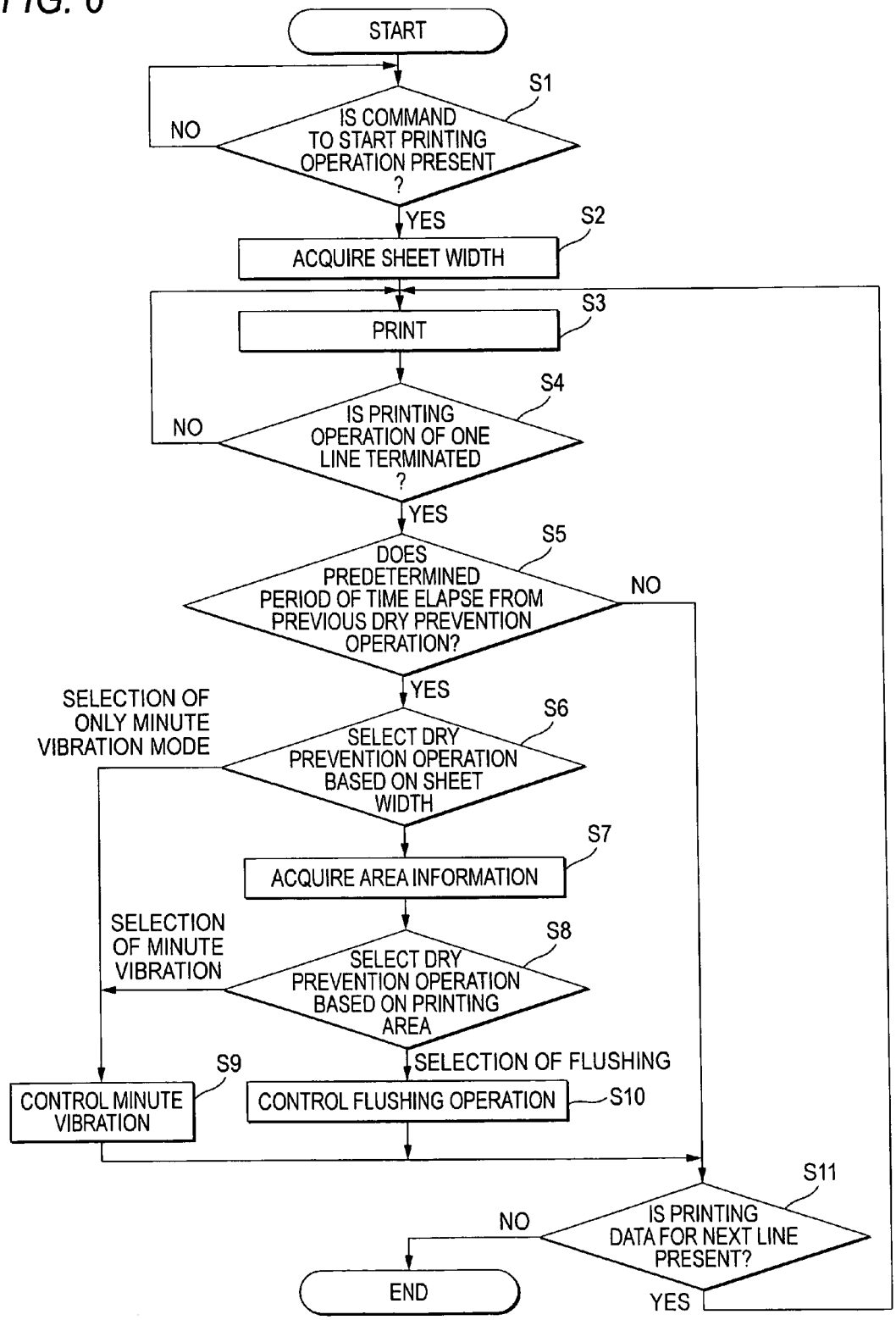
FIG. 6 is a flowchart illustrating a control operation performed by a controller in FIG. 3.

In FIG. 6, when the controller 100 receives a command to start a printing operation from a PC (Yes in S1), a recording paper sheet P1 is conveyed to the movement area of the printing head 30 in the sheet conveyance area. The controller 100 moves the printing head 30, and uses the optical sensor 9*a* to scan the recording paper sheet located below the printing head 30. In this way, the controller 100 acquires the width of the recording paper sheet (S2) to function as a length detecting unit. The controller 100 then starts printing control on the basis of the printing pattern data received from a PC (S3). When printing on one line is terminated (Yes in S4), the controller 100 determines whether a predetermined time period (which is set based on a time period for which the ink in the nozzle would be dried to adversely affect ejection of the ink, taking into account some margin) has elapsed from the previous dry prevention operation (S5). When the predetermined time period has not elapse (No in S5) and the printing pattern data for the subsequent line is present (Yes in S11), a printing operation for the subsequent line is performed (S3 and S4).

When the predetermined time period has elapsed from the previous dry prevention operation (Yes in S5) and the width of the recording paper sheet acquired in S2 is equal to or less than a predetermined reference value, the controller 100 selects a mode for executing only the minute vibration control (S6), executes the minute vibration control (S9), and moves to an operation of determining whether the printing pattern data for the subsequent line is present (S11).

Alternatively, when the width of the recording paper sheet exceeds the predetermined reference value, the controller 100 additionally acquires information regarding the liquid ejection area (S7). For example, in FIG. 7, in a case in which printing on one line in a liquid ejection area 1 is terminated (S4), a width W1 of the area 1 is obtained as the liquid ejection area information. In a case in which printing on one line in a liquid ejection area 2 is terminated (S4), a width W2 of the area 2 is obtained as the liquid ejection area information. In a case in which printing on one line in a liquid ejection area 3 is terminated (S4), a width W3 of the area 3 is obtained as the liquid ejection area information. Here, each of the areas 1, 2 and 3 is an area of the recording paper sheet P, onto which ink drops are to be ejected for printing, and the widths W1, W2 and W3 respectively correspond to widths of the areas 1, 2 and 3 in the movement direction of the carriage 9 having the ejection head 30. The width W1, W2, W3 can be acquired from the printing pattern data in an image memory 25 as the length of the one line. Alternatively, the width W1, W2, W3 can be calculated from the length of the movement of the carriage 9 which has been moved while ejecting ink drops from the ejection head 30. In this way, the controller 100 can function as an area determining unit. One of dry prevention modes is selected on the basis of the width of the area where the printing has been carried out in S3 and S4 (S8). When the width is equal to or less than a predetermined reference value, the minute vibration control is executed (S9). Alternatively, when the width exceeds the predetermined reference value, the flushing operation control is executed (S10). In this connection, the reference value used in step S6 and the reference value used in step S8 may be set as the same value, or alternatively may be set as different values. Subsequently, the controller 100 determines whether the printing pattern data for the subsequent line is present (S11). When no printing pattern data is present (No in S11), the controller 100 ends this process.

That is, when the width of the recording paper sheet or the width of the printing area is equal to or less than the predetermined reference value, it is presumed that the carriage 9 reciprocates within a narrow range, and therefore the movement of the carriage 9 to the flushing area requires an additional extra time. For this reason, the minute vibration control is executed at the decelerating and/or accelerating time when the movement of the carriage 9 is reversed in order to save the time required to move the carriage 9 to the flushing area. Alternatively, when the width of the printing area exceeds the predetermined reference value, the carriage 9 has been already moved to a position near the flushing area 2 or 4 to complete printing on one line. Consequently, the carriage 9 is additionally moved to the flushing area 2 or 4 close to the position after one line printing on the one line is completed, and the flushing operation control is executed.

Here, the reference value of the width of the recording paper sheet or the width of the printing area is set to, for example, 70% of the width of the sheet conveyance area. Alternatively, the reference value may be set to the width of a standard postcard. Alternatively, the reference value may be set to a ratio of the width of the recording paper sheet or the width of the printing area to a distance between the two flushing areas 2 and 4.

In the flowchart shown in FIG. 6, S2 of "acquisition of the sheet width" and S6 of "selection from the sheet width to the dry prevention operation" may be omitted, and the dry prevention operation may be selected only from the width of the printing area. In addition, S7 of "acquisition of area information" and S8 of "selection of the dry prevention operation from the printing area" may be omitted, and the dry prevention may be selected only from the sheet width assuming that the sheet width is substantially equal to the printing area.

FIG. 8 is a diagram for explaining another example as to how to obtain liquid ejection area information. The same flowchart as that of FIG. 6 can be applied to this example. As the area information in S7, the controller 100 obtains end positions L1 to L4 (end positions in the movement direction of the carriage 9) of printing areas 4 to 6. This way, the controller 10 can function as the area determining unit. The information regarding the end positions can be acquired from both ends of one line of the printing pattern data in the image memory 25. Alternatively, the information regarding the end positions can be also acquired from both ends of the movement of the carriage 9 which has been moved while ejecting ink drops from the ejection head 30.

Since the flushing areas 2 and 4 are located at fixed positions in a case la, a distance between the end position L1, L2, L3, L4 of the printing area 1, 2, 3 and the flushing area 2, 4 in the movement direction of the carriage 9 can be calculated by the controller 100. In FIG. 8, for example, when the carriage 9 is moved from the left side to the right side and the printing head 30 is located at the end position L3 after the printing head 30 has printed one line, the controller 100 determines whether a distance D1 between L3 and the flushing area 2 in an extension movement direction of the carriage 9 is equal to or less than a predetermined reference value or exceeds the predetermined reference value. Subsequently, one of the dry prevention modes is selected on the basis of the determination result (S8). When the distance D1 exceeds the predetermined value, the minute vibration control is executed (S9). Alternatively, when the distance D1 is equal to or less than the predetermined value, the flushing operation control is executed (S10). Similarly, when the carriage 9 is moved from the right side to the left side and the printing head 30 is located at the end position L1 after the printing head 30 has printed one line, one of the dry prevention modes is selected on the basis of a distance D3 between L1 and the flushing area 4 in the extension movement direction of the carriage 9 (S8).

Here, for example, the predetermined reference value for the distance between the end position and the flushing area can be set to 40% of the distance between the two flushing areas 2 and 4. Since the distance between the sheet conveyance area and the flushing area is fixed, the dry prevention mode may be selected on the basis of the distance between the above-described end position and the end of the sheet conveyance area.

Further, for example, the distances (D1 and D2) between the end position L3 and the respective flushing areas 2 and 4 may be compared with each other, and if one or both of the distances is equal to or less than the predetermined value, the carriage 9 may be moved to the closer flushing area to execute the flushing operation control. In addition, the dry prevention mode may be selected in consideration of a time period required to move the carriage 9 the distance D1 from the end position L3 and a deceleration and acceleration time period required when the direction of the carriage 9 at the end position L3 is switched from the right side to the left side.

Figure 9:
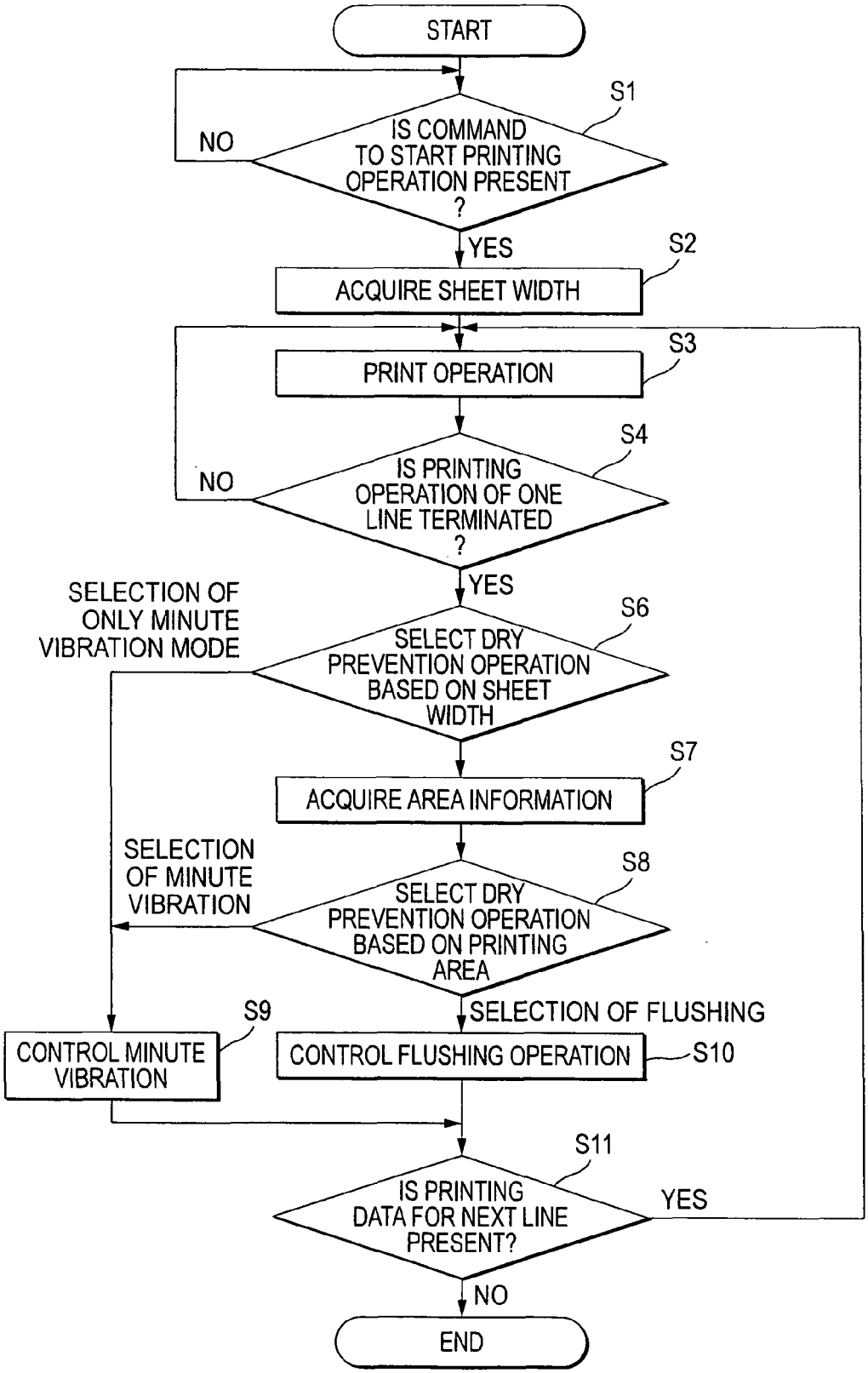
FIG. 9 is a flowchart illustrating another control operation performed by the controller in FIG. 3.

FIG. 9 is a flowchart showing another example. In contrast to the flowchart shown in FIG. 6, the flowchart shown in FIG. 9 does not consider an elapsed time period from the previous dry prevention operation, and does execute the dry prevention operation each time after one line is printed. A difference between the flowchart in FIG. 9 and the flowchart in FIG. 6 is that step S5 is not performed. Since the other steps in FIG. 9 are performed in the same manner as those in FIG. 6, the description is omitted. Each time after one line is printed, the dry prevention operation is selected in S6 and S8.

In this connection, the step S4 of the flowchart shown in FIG. 9 may be modified so that the dry prevention operation is performed each time after plural lines are printed. Further, the minute vibration control may be executed each time after one line or several lines are printed, and the flushing operation control may be executed each time after more lines (more than the one line or several lines) are printed.

MODIFIED EXAMPLE

The invention has been discussed with reference to the printer 1 shown in FIG. 1. However, the invention is not limited to the above-described printer 1, but may be modified in various forms.

For example, the ink-jet printer has been used in the above-described embodiments. However, the invention may be applied to an apparatus which ejects another type of a liquid, such as a coloring liquid to be coated on a color filter of a liquid crystal device. The actuator unit having the piezoelectric layer has been used, but an actuator unit using another method such as a thermal method may be used. Further, an actuator unit which has a laminated structure different from that shown in FIG. 2 may be used.

A more specific selection condition than the conditions discussed with reference to the flowcharts shown in FIGS. 6 and 9 may be set. For example, the controller 100 may select the flushing operation in a case where it is judged from the printing pattern data that the printing area is formed by continuous ten or more lines of which the width is 70% or more of the width of the sheet conveyance area. Alternatively, the controller 100 may select the flushing operation in a case where it is judged from the printing pattern data that the printing area is formed by continuous ten or more lines in which the distance between the left end of the printing area and the left end of the sheet conveyance area is 30% or less of the width of the sheet conveyance.

In place of the optical sensor 9*a* fixed to the carriage 9 to determine the width of the recording paper sheet, a sheet width guide may be used to determine the width of the recording paper sheet. That is, the sheet width guide is adjustably provided in a sheet feeding device (not shown) to contact an edge of the recording paper sheet in the width direction to guide the recording paper sheet, and the width of the recording paper sheet may be acquired by detecting an adjustment amount of the sheet width guide. Alternatively, the width of the recording paper sheet may be acquired on the basis of the printing setting information transmitted along with the printing pattern data from an external apparatus such as a PC.

As in a case of a plotter, the liquid ejection head in the liquid ejection apparatus may be moved in two-dimensional directions including the predetermined direction. Further, the liquid ejection head in the liquid ejection apparatus may be attached to, for example, a robot arm so that the liquid ejection head can be moved in three-dimensional directions including the predetermined direction.

The present invention can provide at least the following illustrative, non-limiting embodiments:

(1) A printing apparatus including: a carriage that can reciprocate along a medium in a predetermined direction; a liquid ejection head that includes a liquid passage having a nozzle and a driving member applying, to a liquid in the liquid passage, ejection energy for ejecting the liquid onto the recording medium from the nozzle and that is mounted on the carriage to move along with the carriage in the predetermined direction; a printing controller that controls movement of the carriage in the predetermined direction and a liquid ejection operation of the liquid ejection head on the basis of input printing pattern data to perform a printing operation on a printing area of the recording medium; a flushing operation controller that moves the carriage to a flushing area located outside the printing area in the predetermined direction and that drives the driving member of the liquid ejection head irrespective of the printing pattern data to eject the liquid from the nozzle to the flushing area; a minute vibration controller that drives the driving member of the liquid ejection head by using small energy so as not to eject the liquid from the nozzle thereby vibrating the liquid in the nozzle; an area determining unit that determines the printing area in the predetermined direction on the basis of the printing pattern data; and a dry prevention mode determining unit that selectively drives one of the flushing operation controller and the minute vibration controller on the basis of the printing area determined by the area determining unit when the liquid ejection head is moved in the predetermined direction to perform the printing operation.

Since the carriage mounting the head thereon has to be moved to the flushing area to execute the flushing operation, unnecessary movement of the carriage is required to lower a printing speed. In contrast, the minute vibration operation does not require the unnecessary movement of the carriage to the flushing area nor unnecessary consumption of the liquid. However, since the minute vibration operation requires to drive the driving unit more number of times, compared with the flushing operation, to prevent dry of the liquid, the minute vibration operation, the minute vibration operation causes more heat generated in various components, which may shorten time period the printing apparatus can execute the printing operation continuously. In contrast, according to the printing apparatus of (1), the dry prevention mode determining unit determines to perform one of the flushing operation and the minute vibration operation on the basis of the printing area. In a case in which it is determined that a time period necessary to move the carriage from the printing area to the flushing area is not so long, the dry prevention mode determining unit selects the flushing operation. The dry prevention mode determining unit selects the minute vibration operation in another case. Accordingly, the printing apparatus of (1) can prevent a printing time period from becoming longer and a heating amount from becoming excessive.

(2) The printing apparatus of (1), in which the dry prevention mode determining unit selectively drives one of the flushing operation controller and the minute vibration controller on the basis of a length of the printing area in the predetermined direction determined by the area determining unit. According to the printing apparatus of (2), when the width of the printing area (length of the printing area in the movement direction of the carriage) is large, the flushing operation is performed after the printing operation of the printing area because a time period required to move the carriage to the flushing area is not so long. On the other hand, when the width of the printing area is short, the minute vibration operation is performed because the time period required to move the carriage to the flushing area is relatively long. Accordingly, the printing apparatus of (2) can prevent the printing time period from becoming longer and the heating amount from becoming excessive.

(3) The printing apparatus of (1), in which the area determining unit determines one end position of the printing area in the predetermined direction, and the dry prevention mode determining unit selectively drives one of the flushing operation controller and the minute vibration controller on the basis of a distance between the end position and the flushing area in the predetermined direction. According to the printing apparatus of (3), when the printing area and the flushing area is close to each other, the flushing operation is performed because the time period required to move the carriage to the flushing area is not so long. On the other hand, when the printing area and the flushing area is far away from each other, the minute vibration operation is performed because the time period required to move the carriage to the flushing area is relatively long. Accordingly, the printing apparatus of (3) can prevents the printing time period from becoming longer and the heating amount from becoming excessive.

(4) The printing apparatus of any one of (1) to (3), further including a length detecting unit that detects a length of the medium in the predetermined direction, and in which when the length of the medium in the predetermined direction detected by the length detecting unit is equal to or less than a predetermined value, the dry prevention mode determining unit drives only the minute vibration controller. According to the printing apparatus of (4), when the width of the medium (the length of the medium in the movement direction of the carriage) is small, it is determined that the time period required to move the carriage to the flushing area is relatively long, and therefore only the minute vibration operation is performed. Accordingly, the printing apparatus of (4) can prevents the printing time period from becoming longer and the heating amount from becoming excessive.

(5) The printing apparatus of any one of (1) to (4), in which the area determining unit determines the printing area each time after the carriage is moved in the predetermined direction a predetermined number of times, and the dry prevention mode determining unit selectively drives one of the flushing operation controller and the minute vibration controller on the basis of the printing area determined by the area determining unit each time after the carriage is moved in the predetermined direction the predetermined number of times. According to the printing apparatus of (5), it is possible to determine to execute one of the flushing operation and the dry prevention operation each time after the carriage is moved the predetermined number of times. Therefore, the printing apparatus of (5) can shorten the printing time period and suppress the heat generation in an optimal fashion.

(6) The printing apparatus of any one of (1) to (4), in which the dry prevention mode determining unit selectively drives one of the flushing operation controller and the minute vibration controller on the basis of the printing area determined by the area determining unit after the printing operation for one line in the printing area is completed, provided that an elapsed time period from a previous drive of the flushing operation controller or the minute vibration controller exceeds a predetermined time period. According to the printing apparatus of (6), since the flushing operation or the minute vibration can be performed during the printing operation at the timing suitable for the dry prevention, an unnecessary flushing operation or minute vibration can be avoided to eliminate a wasteful printing time period and heat generation.

What is claimed is:

1. A printing apparatus comprising:

a carriage that can reciprocate along a medium in a predetermined direction;

a printing head that includes:

a liquid passage having a nozzle; and a driving member applying, to a liquid in the liquid passage, ejection energy for ejecting the liquid onto the medium from the nozzle and that is mounted on the carriage to move along with the carriage in the predetermined direction;

a printing controller that controls movement of the carriage in the predetermined direction and a liquid ejection operation of the printing head on the basis of input printing pattern data to perform a printing operation on a printing area of the medium;

a flushing operation controller that moves the carriage to a flushing area located outside the printing area in the predetermined direction and that drives the driving member of the printing head irrespective of the printing pattern data to eject the liquid from the nozzle to the flushing area;

a minute vibration controller that drives the driving member of the printing head by using small energy so as not to eject the liquid from the nozzle, thereby vibrating the liquid in the nozzle;

a length detecting unit that detects a length of the medium in the predetermined direction;

an area determining unit that determines a size of the printing area in the predetermined direction on the basis of the printing pattern data; and a dry prevention mode determining unit that selects to drive one of the flushing operation controller and the minute vibration controller on the basis of the length of the medium in the predetermined direction, detected by the length detecting unit, and the size of the printing area in the predetermined direction, determined by the area determining unit, when the printing head is moved in the predetermined direction to perform the printing operation;

wherein, when the length of the medium in the predetermined direction detected by the length detecting unit is equal to or less than a predetermined value, the dry prevention mode determining unit drives only the minute vibration controller; and wherein, when the length of the medium in the predetermined direction detected by the length detecting unit is greater than the predetermined value, the dry prevention mode determining unit selects to drive one of the flushing operation controller and the minute vibration controller on the basis of the size of the printing area in the predetermined direction determined by the area determining unit.

2. The printing apparatus according to claim 1;

wherein the dry prevention mode determining unit selectively drives one of the flushing operation controller and the minute vibration controller on the basis of a length of the printing area in the predetermined direction determined by the area determining unit.

3. The printing apparatus according to claim 1;

wherein the area determining unit determines an end position of the printing area in the predetermined direction; and wherein the dry prevention mode determining unit selectively drives one of the flushing operation controller and the minute vibration controller on the basis of a distance between the end position and the flushing area in the predetermined direction.

4. The printing apparatus according to claim 1;

wherein the area determining unit determines the printing area each time after the carriage is moved in the predetermined direction a predetermined number of times; and wherein the dry prevention mode determining unit selectively drives one of the flushing operation controller and the minute vibration controller on the basis of the printing area determined by the area determining unit each time after the carriage is moved in the predetermined direction the predetermined number of times.

5. The printing apparatus according to claim 1;

wherein the dry prevention mode determining unit selectively drives one of the flushing operation controller and the minute vibration controller on the basis of the printing area determined by the area determining unit when the printing operation for one line in the printing area is completed by the printing controller, provided that an elapsed time period from a previous drive of the flushing operation controller or the minute vibration controller exceeds a predetermined time period.

6. The printing apparatus according to claim 1;

wherein the carriage further comprises an optical sensor; and wherein the length detecting unit detects the length of the medium in the predetermined direction by controlling the optical sensor to scan the medium located below the liquid ejection head while moving the carriage in the predetermined direction.

* * * * *